US009765591B2

(12) United States Patent
Ferg

(10) Patent No.: US 9,765,591 B2
(45) Date of Patent: Sep. 19, 2017

(54) SWELLABLE ELASTOMER PLUG AND ABANDONMENT SWELLABLE PLUGS

(71) Applicant: Thomas Eugene Ferg, Sun City West, AZ (US)

(72) Inventor: Thomas Eugene Ferg, Sun City West, AZ (US)

( * ) Notice: Subject to any disclaimer, the term of this patent is extended or adjusted under 35 U.S.C. 154(b) by 79 days.

(21) Appl. No.: 14/703,857

(22) Filed: May 4, 2015

(65) Prior Publication Data

US 2016/0017686 A1 Jan. 21, 2016

Related U.S. Application Data

(60) Provisional application No. 61/988,885, filed on May 5, 2014, provisional application No. 62/002,138, filed on May 22, 2014.

(51) Int. Cl.

| | |
|---|---|
| ***E21B 33/12*** | (2006.01) |
| ***E21B 33/134*** | (2006.01) |
| ***E21B 33/13*** | (2006.01) |

(52) U.S. Cl.

CPC ..... *E21B 33/1208* (2013.01); *E21B 33/13* (2013.01); *E21B 33/134* (2013.01)

(58) Field of Classification Search

CPC . C04B 28/02; C04B 2103/0049; E21B 33/14; E21B 33/13; E21B 33/1208;

(Continued)

(56) References Cited

U.S. PATENT DOCUMENTS 3,385,367 A 5/1968 Kollsman
4,936,386 A * 6/1990 Colangelo ..... C09K 8/50 166/180

(Continued)

OTHER PUBLICATIONS

Tech. Subgroup, Operations & Environment Task Group, National Petroleum Council, Working Document of the NPC North American Resource Development Study, Paper #2-25, Plugging and Abandonment of Oil and Gas Wells, Made Available Sep. 15, 2011, 21 pages.

*Primary Examiner* — Zakiya W Bates
(74) *Attorney, Agent, or Firm* — Karen B. Tripp

(57) ABSTRACT

A process for plugging a wellbore, e.g., an oil or gas well, which comprises installing swelling elastomer sealing units across an interval of casing which is properly in the annulus space between the outside of the casing and the rock face. The swellable elastomer sealing units can also be used to seal off perforated casing, production screen and open hole completions. The plug and abandonment system is comprised of swelling elastomer units that are connected together to achieve a desired sealing contact length. These connected units may be hung off below or placed above a packer, cement retainer, cast iron bridge plug or setting slips. Both the tubular form of the plugging unit and the rod form of the plugging unit can be used in conjunction with conventional settable medium (cementing, barite or sized aggregate) plug setting operations. The elastomers incorporated are designed to swell with the current wellbore fluid and/or any possible future wellbore fluid. The swelling elastomers create sufficient expansion force to effectively seal off the wellbore internal to the casing, liner, screen or open-hole interval.

9 Claims, 17 Drawing Sheets

(58) Field of Classification Search
CPC ..... E21B 33/124; E21B 33/134; E21B 43/12; E21B 33/12; E21B 33/1243; E21B 33/16; C09K 8/467; C09K 8/42; C09K 8/422; C09K 8/426
See application file for complete search history.

(56) References Cited

U.S. PATENT DOCUMENTS

| | | | | |
|---|---|---|---|---|
| 7,059,415 | B2 | 6/2006 | Bosma et al. | |
| 7,143,832 | B2 | 12/2006 | Freyer | |
| 2009/0188678 | A1* | 7/2009 | Brooks ..... | E21B 33/1208 166/386 |

* cited by examiner

SWELLABLE ELASTOMER PLUG AND ABANDONMENT SWELLABLE PLUGS

RELATED APPLICATIONS

This application claims priority from U.S. Provisional Patent Application No. 61/988,885, filed May 5, 2014 by Thomas Eugene Ferg, entitled "Swellable Elastomer Plug and Abandonment Sealing Plug,", and from U.S. Provisional Patent Application No. 62/002,138, filed May 22, 2014, by Thomas Eugene Ferg, entitled "Swellable Elastomer Well Completion Abandonment Sealing Plugs,".

FIELD OF THE INVENTION

This invention relates to a method and apparatus for placement of sealing plugs within a wellbore for the purpose of permanent plug and abandonment or temporary suspension. This invention can be used as a stand-alone plug and abandonment cross-sectional barrier or it may be combined with plugs comprised of setting medium (examples; cement, polymers, plastic, Barite or sized aggregate). This invention can be used to plug and abandon a well cemented cased wellbore, as well as perforated, open-hole and screened completion intervals within a wellbore. This invention also relates to the plugging of a wellbore (such as e.g. an oil, gas or water injection well), or for preparing a wellbore to be plugged, e.g. when the wellbore has reached the end of its productive or economic life. The invention also relates to a plugged wellbore.

BACKGROUND OF THE INVENTION

When an oil or gas well is no longer economical, or if there is a mechanical problem with the well which means that production is no longer possible or that well integrity has been compromised in some way, or for other reasons, the well may be abandoned. It is common practice to plug the well before abandoning it, e.g., to place barriers within the wellbore to prevent seepage of hydrocarbon product or water from the wellbore to the external environment. This can also apply to water injectors, i.e. bores which have been drilled in order to pump water into a reservoir to increase bottom hole pressure or to sweep hydrocarbon fluids to production wells.

Commonly, in a well with a good primary cement job external to the casing, plugging is accomplished by the placement of balanced cement plugs inside of the casing across from these well cemented intervals as required. The most common plugging medium is an oilfield cement slurry. The slurry can be designed to be gas tight and provide a barrier to upward fluid moment within the wellbore. When set and tested this creates a full cross-sectional barrier extending from inside the casing to outside of the casing and to the rock face.

Other plugging mediums such as settable plastic, barite and sized aggregate have also been used to place barriers internal to oilfield tubulars within well cemented external annuli intervals.

Cast iron bridge plugs, cement retainers and packers with a through-bore plug may be used as mechanical bases for placement of settable medium plugs.

Settable mediums can, by their nature, be very hard and exhibit brittle characteristics when subjected to external lateral force, such as compression or tension caused by subsidence or fault shifting of the strata in contact with the wellbore. If the settable medium is fractured post setting it possesses no mechanism to heal itself and regain cross-sectional integrity.

For plugging operations using cement, the plugging process often involves pumping a surfactant liquid, known as a "spacer", down a drill string or work-over string (commonly referred to as the "string") into the well taking returns up the string-by-casing annulus. The purpose of the spacer is to remove oil residues from the internal surface of the well casing and/or liner making them "water wet" (allowing better adhesion by cement). Commonly, immediately following the spacer, cement is pumped down the string and placed as a balanced plug. The string is then slowly removed from the wet balanced cement plug by pulling the string out of the hole until the bottom end of the pipe is above the cement slurry. The drill string and annulus are then circulated clean. The cement is allowed time to set and then the work string is used to tag (lowered down to contact resistance) and confirm the top of hard cement. Additional cement plugs can then be set with the same procedure or the string may be pulled from the wellbore.

If the plug is not correctly displaced or properly balanced prior to pulling the placement string above the cement slurry surface, the strength and integrity of the plug may be jeopardized because of cement contamination. The degree to which the cement plug integrity may be compromised can be difficult to assess.

Cement setting time can be monitored at surface by placing samples of the pumped cement slurry into a testing apparatus that recreates downhole conditions. When it has been determined that the downhole plug has achieved sufficient strength; the plug is pressure tested and tagged with the end of the work string to confirm the top of hard cement.

Abandonment plugs may also be placed in perforated completion intervals or in sections completed with screens.

To place a sealing plug inside of casing across from perforated intervals cement is most commonly used. To create an internal seal cement is squeezed through the perforations until the perforations are squeezed off and pressure builds within the tubular. This operation may require repeated squeeze operations before the perforations are squeezed (sealed) off and this repetition is time consuming. Incorporation of particulate material into the cement slurry along with ball sealers may also be required.

The sealing off of internal intervals with screens may be difficult because of the large open surface area. Cement has been used in conjunction with sized particulate material to seal off flow paths in order to fill the screen with cement and with the intent of retaining the cement inside of the screen. As flow paths are sealed off, the screen is progressively filled with cement plugging off the screen and creating an internal plug.

SUMMARY OF THE DISCLOSURE

The invention includes a process for plugging a wellbore wherein the process comprises the steps of introducing and installing swellable elastomer plug units into a cased and cemented wellbore, a perforated completion, or a screen completion, for the purpose of creating a cross-sectional barrier which prevents fluid or gas movement upward in a wellbore.

Swellable elastomers placed on a single rod or tubular are considered to be swellable elastomer plug units.

When swelling elastomer sealing plug units are attached together or run along with a bridge plug, cement retainer, or packer, the combined components are considered to be a system.

Swellable elastomer plug units may be linked up at surface and pumped downhole to the desired setting/expansion location.

Swellable elastomer units may also be pumped downhole singly and then meet up downhole at a desired setting/expansion location.

These swellable elastomer plug units may be made entirely of a single type of elastomer which is swelling sensitive to only hydrocarbons.

These swellable elastomer plug units may be made entirely of a single type of elastomer which is swelling sensitive to only water or brine.

Swellable elastomer plug units may be made to incorporate both hydrocarbon and water/brine swellable elastomers within the same unit.

Swellable elastomer plug units may be used to create a plug system which incorporate units of both hydrocarbon and water/brine swellable elastomers.

Swellable elastomers may be cut into circular disks with a central hole for threading onto a steel rod or tubular.

Swellable elastomers may be wrapped around a rod or tubular in sheet form.

Swellable elastomers may be applied to a rod or tubular by spray application.

Swellable elastomer disks, swellable elastomer wraps, or spray applied swellable elastomers with both water and hydrocarbon swelling characteristics, may be incorporated into a single swelling elastomer unit.

Swellable circular disks can be grouped into intervals with the same swelling characteristics (hydrocarbon or water/brine swelling) or elastomers with different swelling characteristics may be alternated in their placement along the rod/tubular unit.

Using connections to link swelling elastomer segments together allows for creation of a complete plug system of any desired length or swelling characteristics.

Swellable elastomer units may be created by use of an injection mold process without a central rod or tubular.

In certain embodiments, the swellable elastomer plug may be able to bridge or close gaps which can form because of casing deformations caused by rock formation fault shifting, causing collapse compression and tension failure of casing.

In certain embodiments the swelling elastomers may remain dormant until an activation agent is introduced into the wellbore and contacts the swelling elements.

The term swelling of the elastomer components is meant to indicate an increase in volume of the material through molecular incorporation of fluid components. However, other swelling mechanisms may be used if desired.

Swelling of the material to be expanded may occur through contact with an activation agent, such as an organic or inorganic containing fluid.

Suitable swellable materials for comprising the swelling elastomers may include, but are not limited, to those disclosed in U.S. Pat. Nos. 3,385,367; 7,059,415; and 7,143,832; the entire disclosures of which are incorporated by reference. Some exemplary swellable materials may include, but are not limited to, elastic polymers, such as EPDM rubber, styrene butadiene, natural rubber, ethylene propylene monomer rubber, ethylene-propylene-copolymer rubber, ethylene propylene diene monomer rubber, ethylene propylene-diene terpolymer rubber, ethylene vinyl acetate rubber, hydrogenized acrylonitrile butadiene rubber, acrylonitrile butadiene rubber, isoprene rubber, butyl rubber, halogenated butyl rubber, brominated butyl rubber, chlorinated butyl rubber, chlorinated polyethylene, chloroprene rubber and polynorbornene. In one embodiment, the rubber of the swellable material may also have other materials dissolved in or incorporated within its mixture. The swellable material may also have polyvinyl chloride, methyl methacrylate, acrylonitrile, ethylacetate or other polymers that expand in contact with oil. Units of the swellable elastomers are conveyed into the wellbore by drill pipe, work string, coiled tubing, wireline, braided line, or are hydraulically pumped into position within the wellbore.

The wellbore environment with respect to hydrocarbon or aqueous fluid will determine the suitability of a specific swellable material.

Baffle plates securely attached to the central rod or tubular may be used to redirect longitudinal expansion to radial/circumferential expansion.

The term "wellbore" as used herein shall be taken to mean an oil, gas or water injection well.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Figure 1:
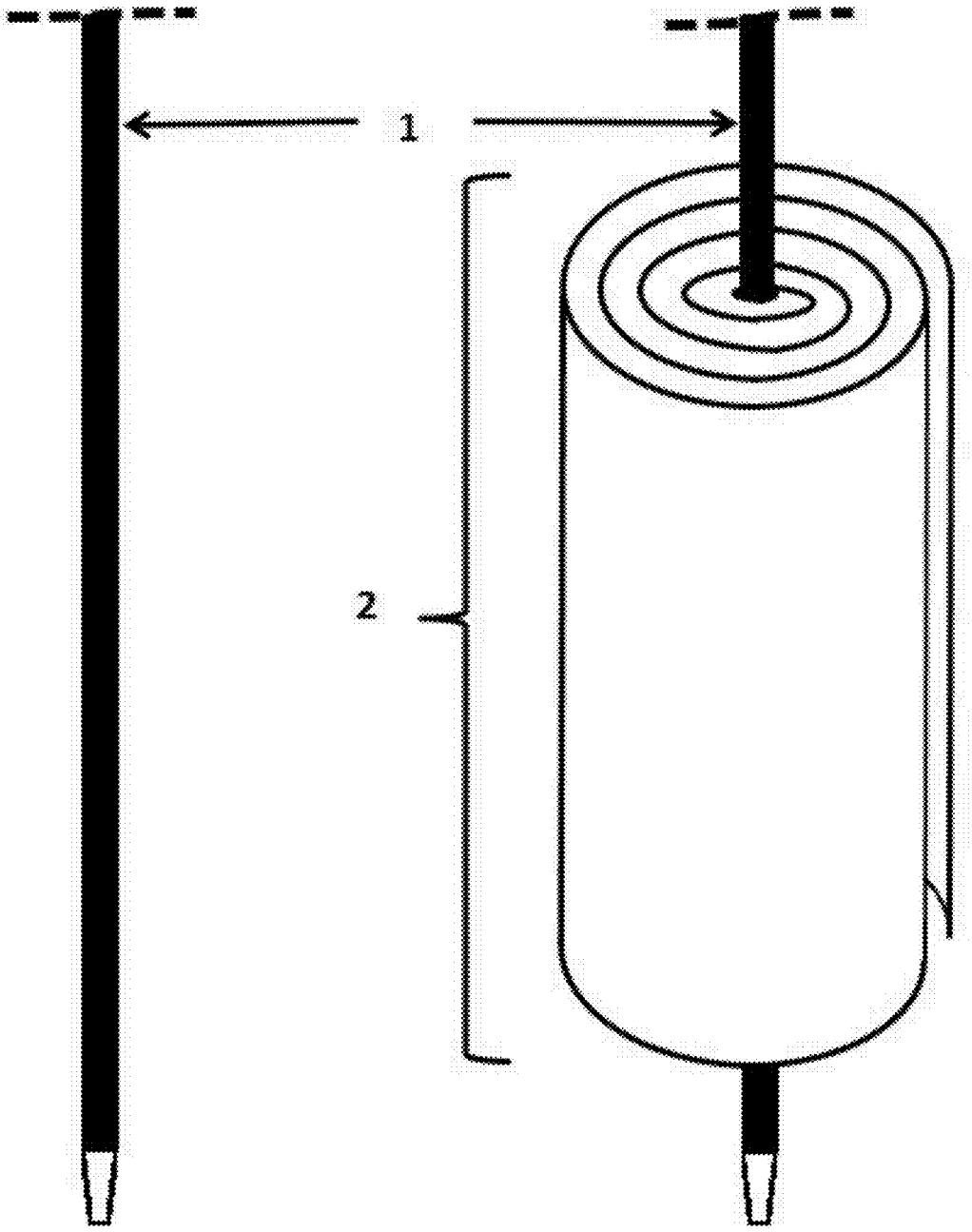
FIG. 1 is an example of a swellable elastomer sheet material (2) being wrapped around a rod core (1)

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The discussion of any reference herein is not an admission that the reference is prior art to the present invention, especially any reference that may have a publication date after the priority date of this application. At the same time, each and every claim below is hereby incorporated into this detailed description or specification as additional embodiments of the present invention.

This invention generally relates to a method and apparatus for placement of cross-sectional elastomer sealing plug(s) within a wellbore for the purpose of creating barriers for permanent plug and abandonment or temporary suspension of wellbores.

The elastomer sealing plug units can be run as a standalone plug and abandonment cross-sectional barrier or they may be combined with cross-sectional cement or other settable medium plugs such as polymers, barite or sized aggregate. This listing of settable mediums is given to provide possible examples; however, there are many others settable mediums which would work in the invention but that are not listed here.

The swellable elastomers units can be utilized as a primary barrier in wells with a confirmed competent primary external casing cement job across the interval requiring a barrier.

The swellable elastomer units can be placed across perforations or screen completions in order to seal off the wellbore. They may also be placed in an openhole environment to seal off the wellbore. Swellable elastomers are, by their nature, pliable. Plug units and barrier systems made with swellable elastomers are malleable and should be compressional. When tensional or lateral forces compromise the casing integrity in the area of plug placement, the elastomer will self-heal, maintaining the barrier seal. This invention also relates to the plugging of a wellbore (such as, e.g., an oil, gas or water injection well). The Figures show various nonlimiting examples of swellable elastomer units that may be used in the invention.

All referenced adhesives are required to be resistant to temperature degradation with time and they must provide bonding of one elastomer layer to the next and/or bonding between the swellable elastomers and a central rod or tubular core if incorporated. Different adhesives may be required to secure the swellable elastomer to a central core rod or tubular or to bond the swellable layers or disks one to another. A volcanizing agent may be used to adhere sellable elastomers one to another. In a process of the invention for permanently plugging a wellbore, the process comprises the following steps: (a) gaining access to the wellbore; (b) running a gauging device into the wellbore to assure passage of all plugging components; (c) running in the wellbore swelling elastomer units; (d) conveying the swelling elastomer units to the planned location within the wellbore; (e) allowing the elastomers to swell; and (f) optionally mixing, pumping, and displacing a settable medium into the wellbore.

FIG. 1 is an example of swellable elastomer material in sheet form being wound around a solid rod core. Adhesives are applied to the rod core (1) and the elastomers (2) as progressive layers are placed around the rod core (1). The swellable elastomers (2) may be either water/brine swellable or hydrocarbon swellable.

Figure 2:
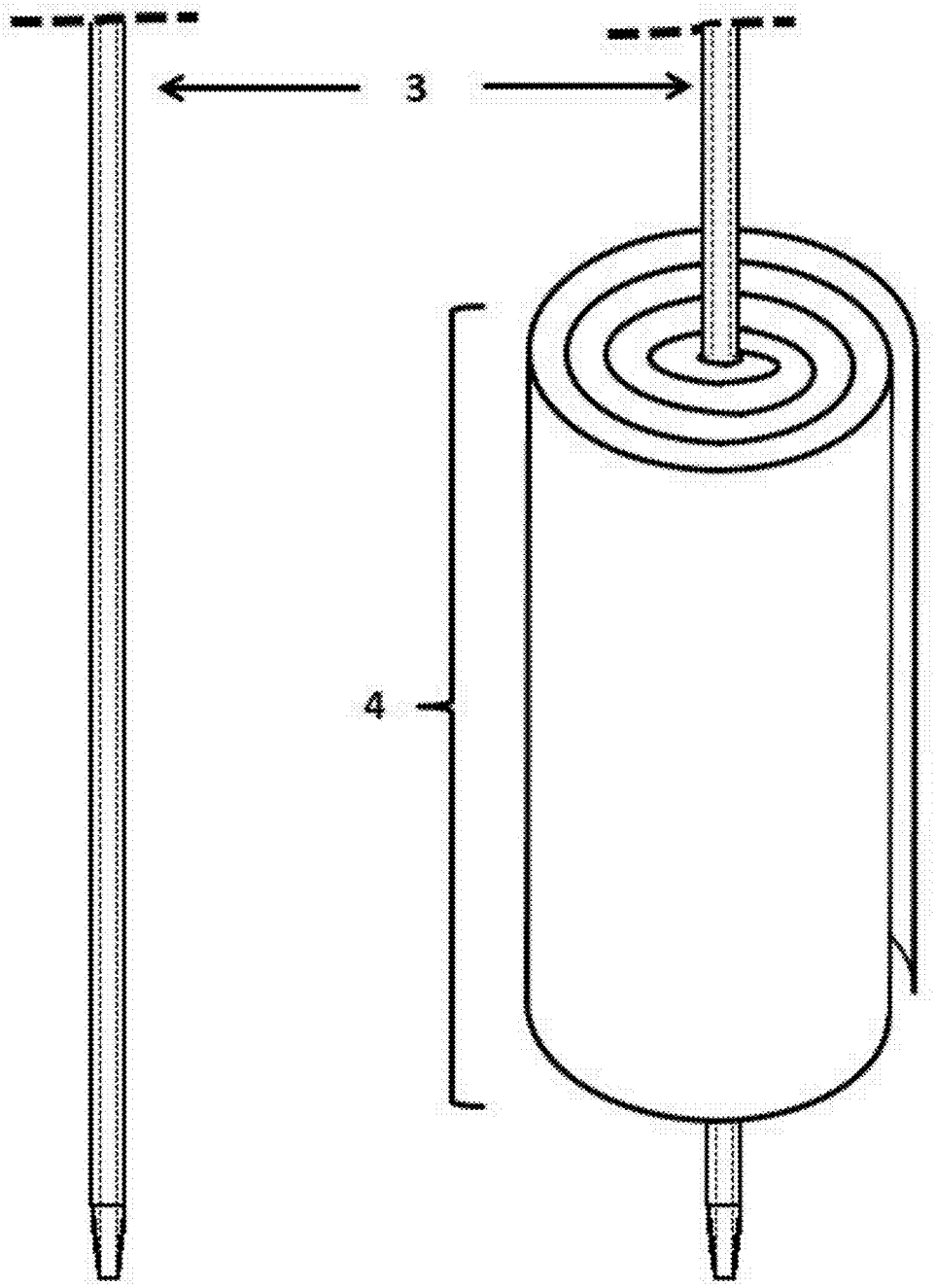
FIG. 2 is an example of a swellable elastomer sheet material (4) being wrapped around a tubular core (3)

FIG. 2 is an example of swellable elastomer material in sheet form being wound around a tubular core. Adhesives are applied to the tubular core (3) and the elastomer (4) as progressive layers are placed around the tubular core (3). The swellable elastomers (4) may be either water/brine swellable or hydrocarbon swellable.

Figure 3:
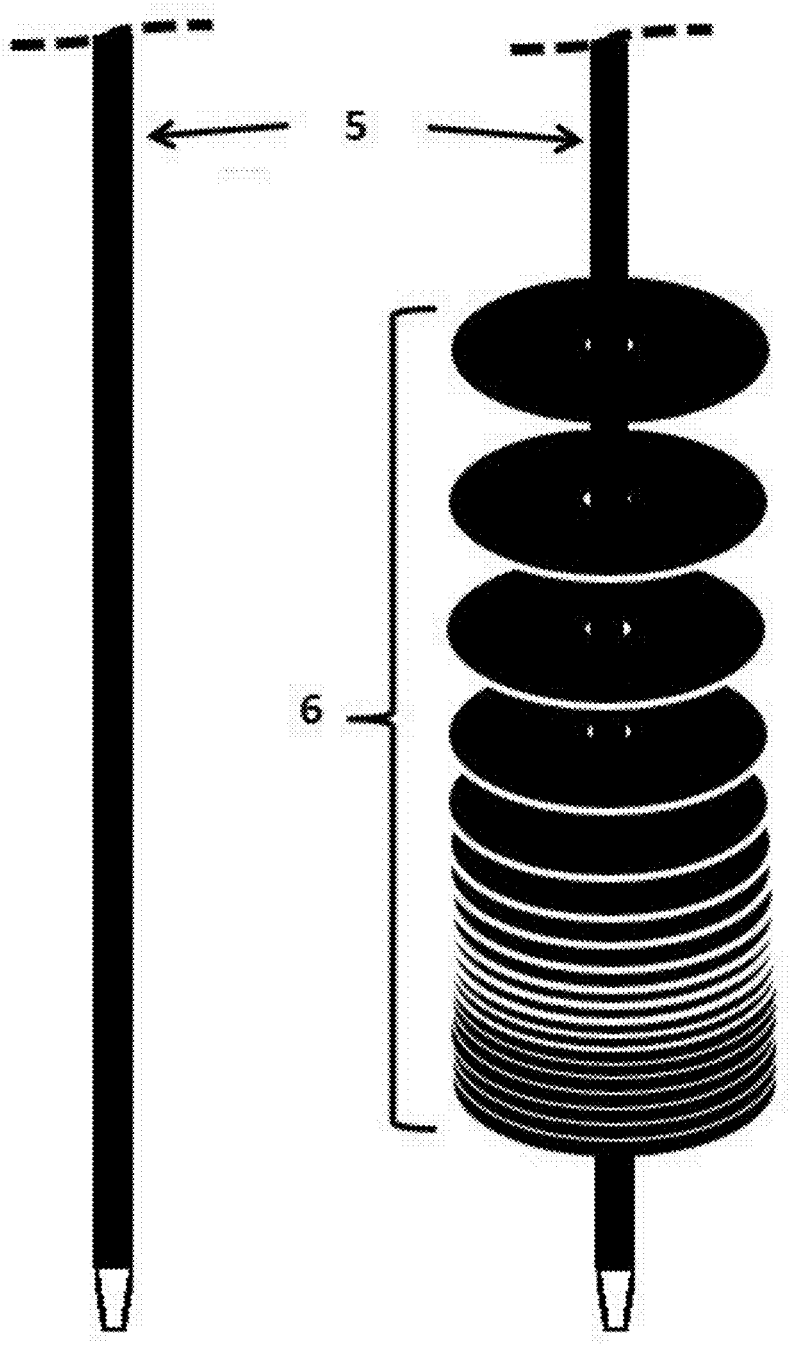
FIG. 3 is an example of swellable elastomer disks (6) being threaded onto a rod core (5)

FIG. 3 is an example of swellable elastomer disks (6) being threaded onto a rod core (5). Adhesives may be used on the rod core (5) and disks (6) to hold them in place. The swellable elastomers (6) may be either water/brine swellable or hydrocarbon swellable.

Figure 4:
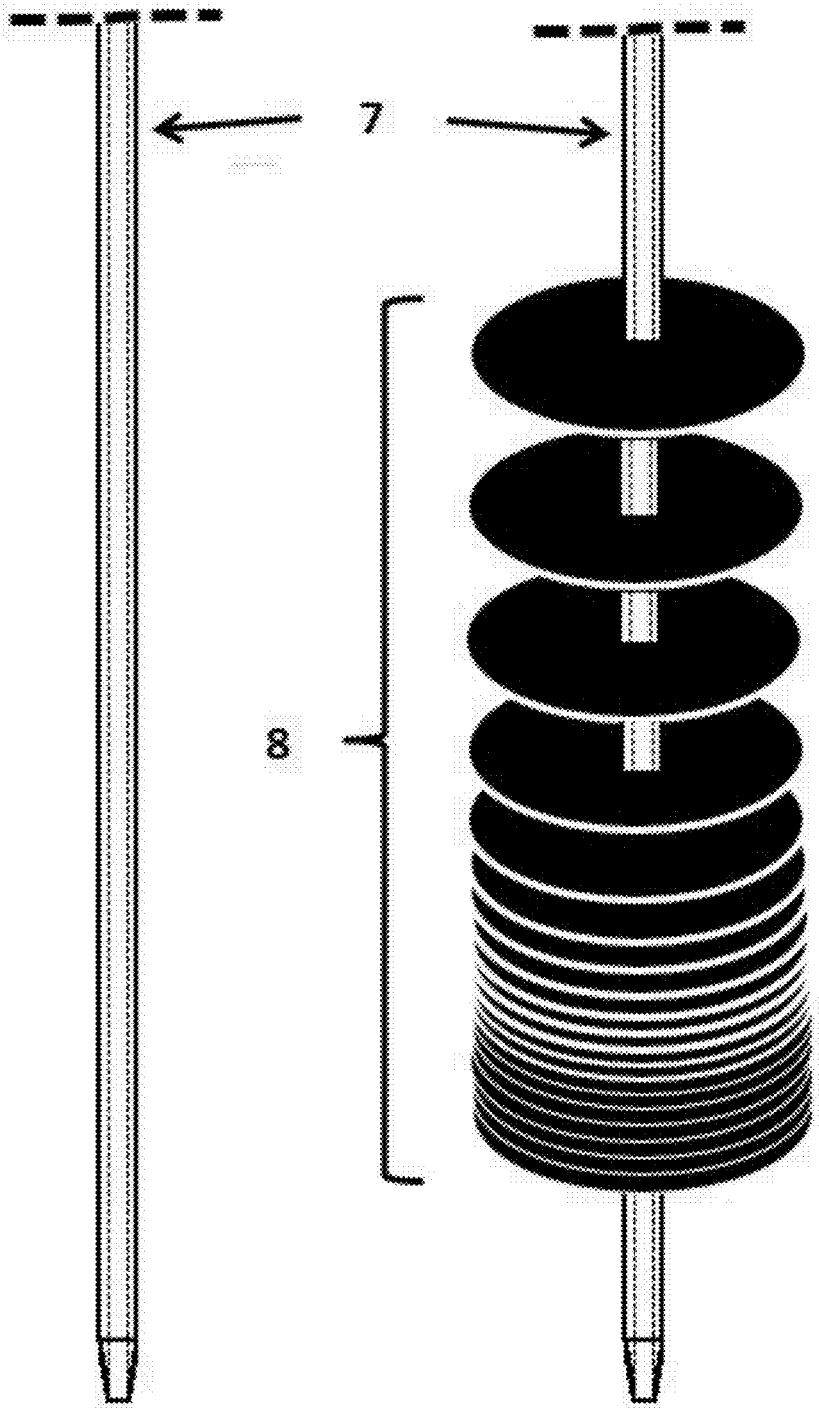
FIG. 4 is an example of swellable elastomer disks (8) being threaded onto a tubular core (7)

FIG. 4 is an example of swellable elastomer disks (8) being threaded onto a tubular core (7). Adhesives may be used on the tubular core (7) surface and disks (8) in order to hold them in place. The swellable elastomers (8) may be either water/brine swellable or hydrocarbon swellable.

Figure 5:
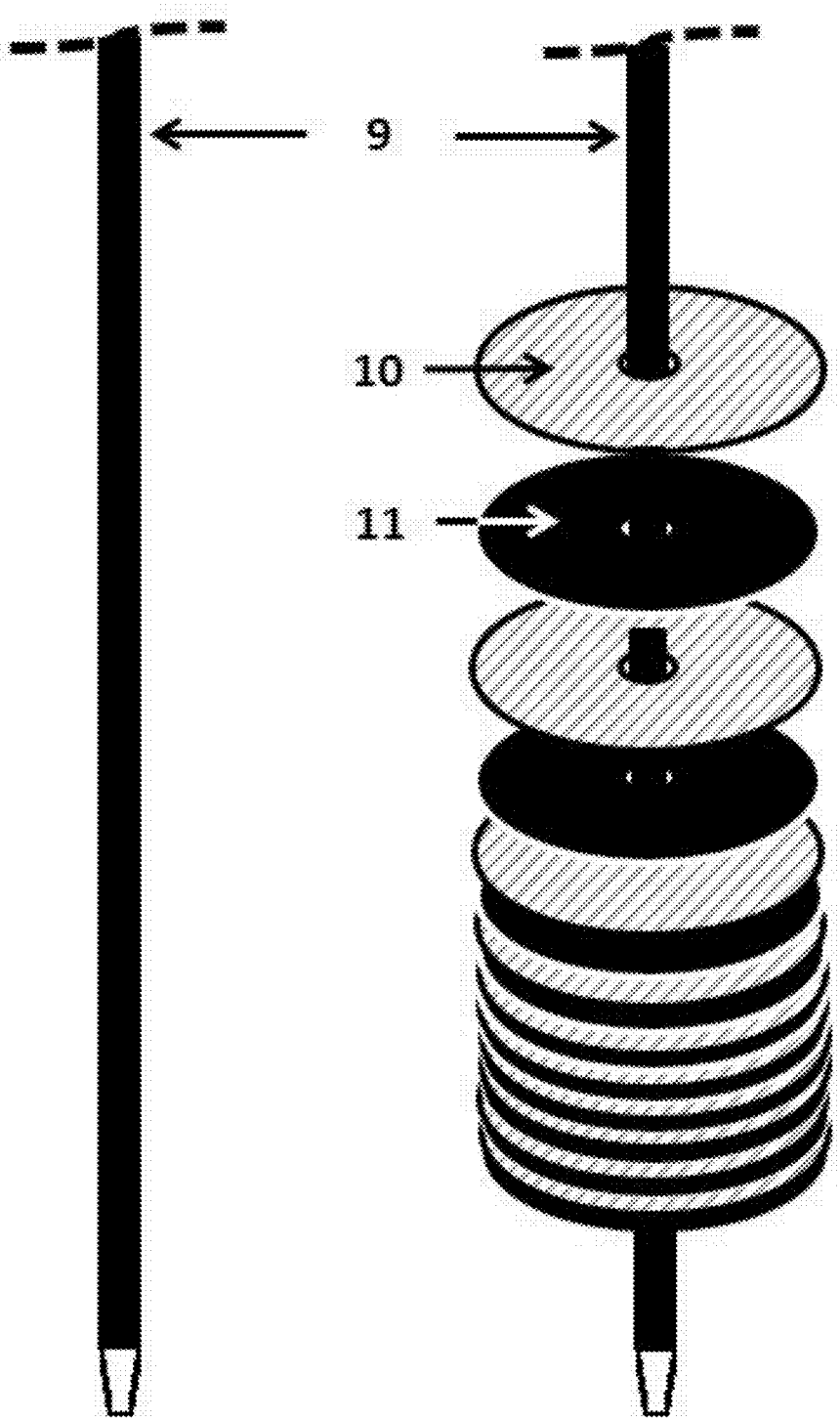
FIG. 5 is an example of both water/brine swellable elastomer disks (10—disks with lines) and hydrocarbon swelling elastomers disks (11—black disks) being threaded onto a rod core (9)

FIG. 5 is an example of swellable elastomer disks being threaded onto a rod core (9). The disks with lines (10) represent water/brine swellable elastomers and the black disks (11) represent hydrocarbon swellable elastomers. The disks (10) and (11) are shown alternating on the rod core (9), although other configurations may be used. Adhesives may be used on the rod core (9) and disks (10) and (11) to hold them in place.

Figure 6:
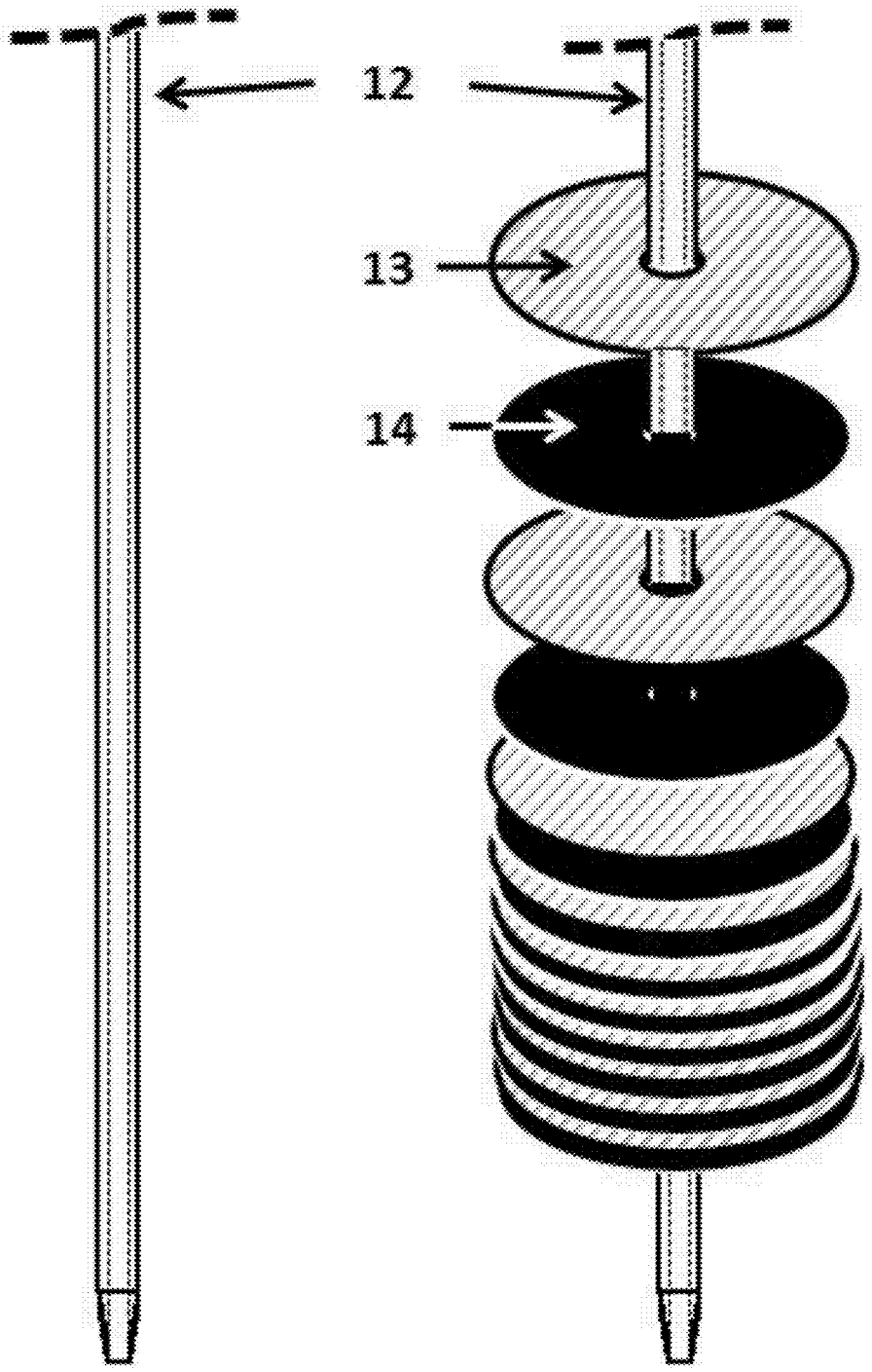
FIG. 6 is an example of both water/brine swellable elastomer disks (13—disks with lines) and hydrocarbon swelling elastomers disks (14—black disks) being threaded onto a rod core (12)
Figure 7:
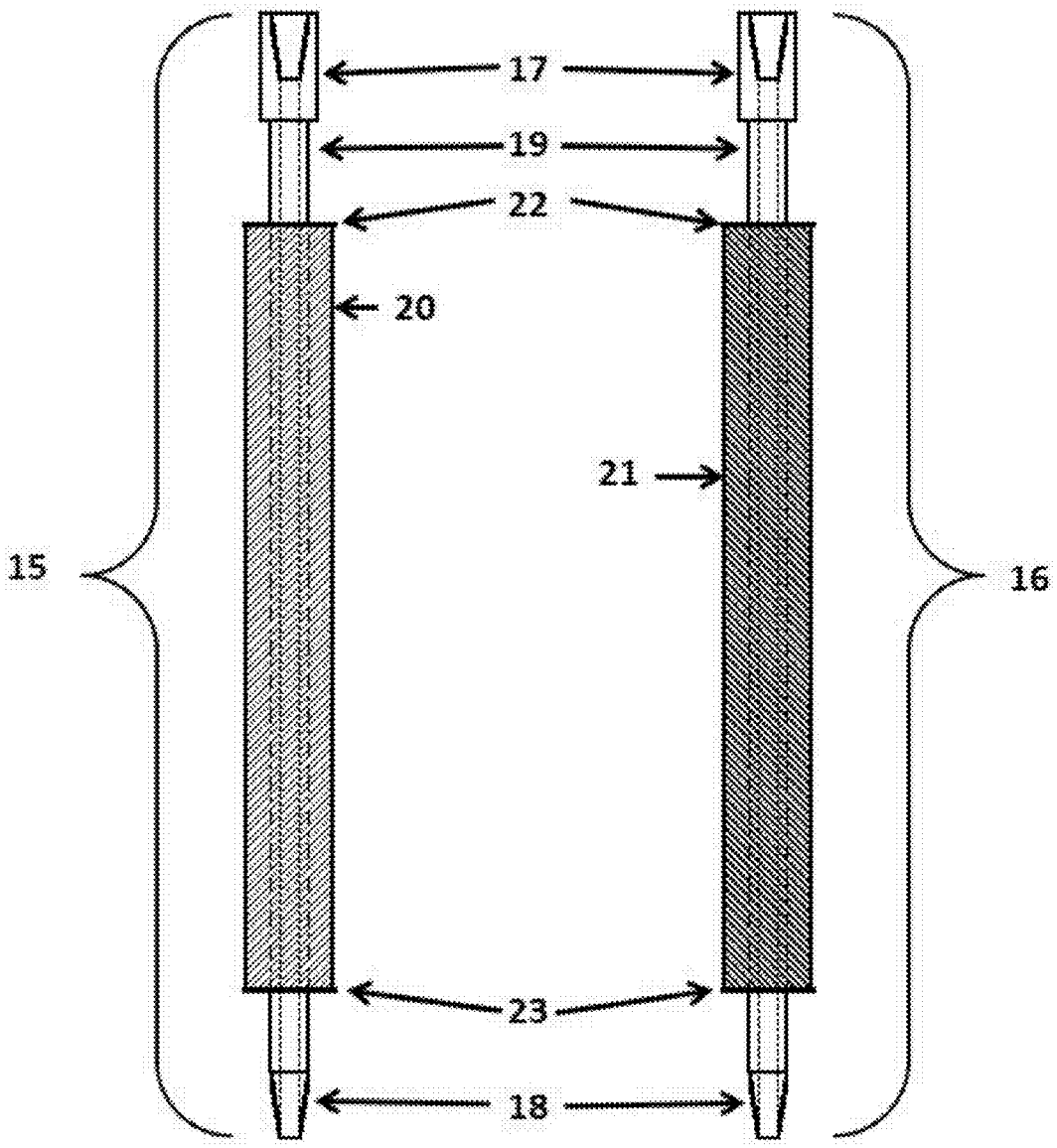
FIG. 7 is a side view of two Sealing Plug Units (15) and (16) of one embodiment of the invention with a tubular core (19) incorporating either water/brine swellable elastomers (20) or hydrocarbon swellable elastomers (21) across the entire unit.
Figure 8:
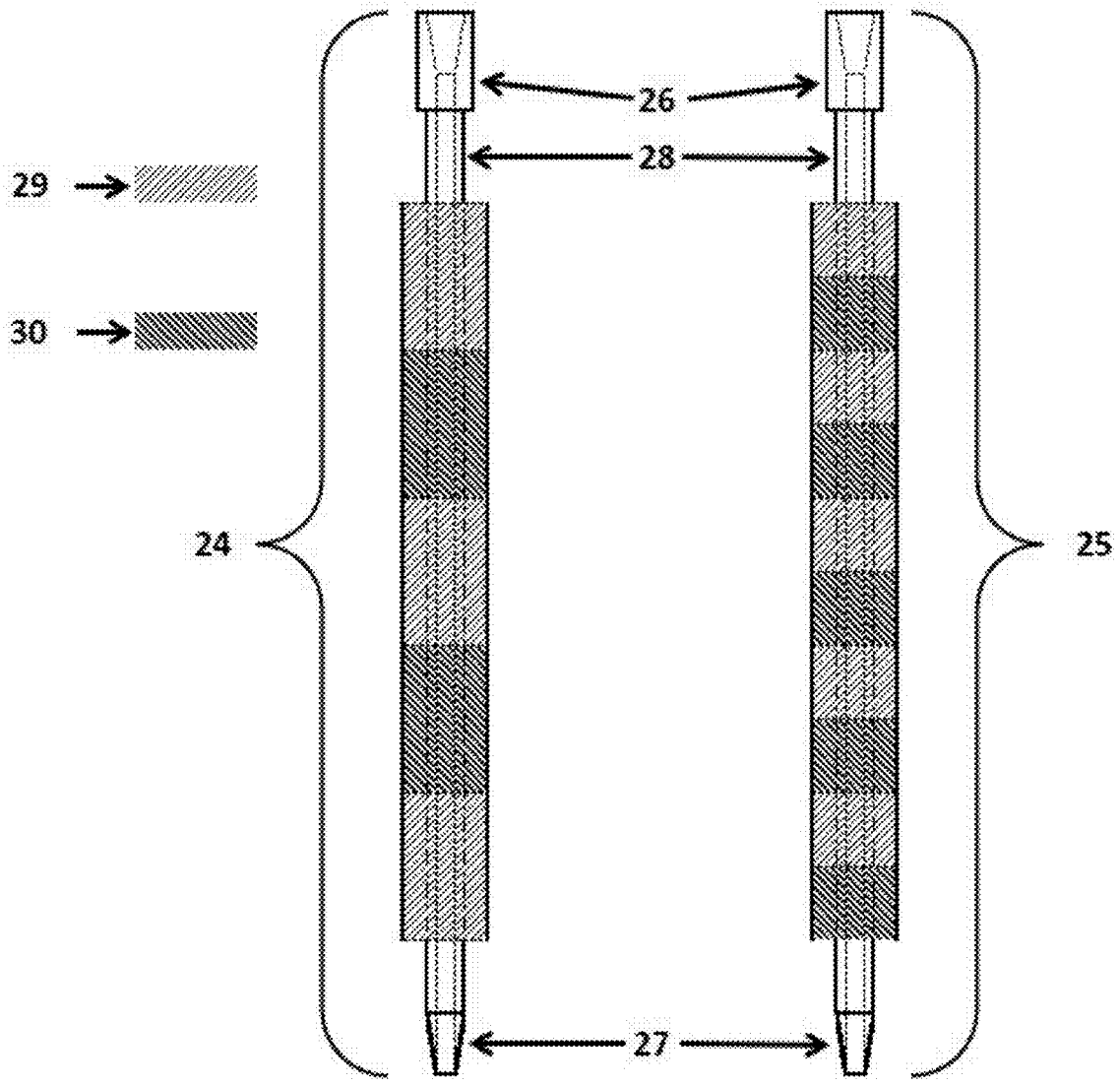
FIG. 8 is a side view of Elastomer Sealing Plug Units (24) and (25) of one embodiment of the invention with a tubular core (28) with alternating water/brine swellable elastomers (29) and hydrocarbon swelling elastomers (30)

FIG. 6 is an example of swellable elastomer disks being threaded onto a tubular core (12). The disks with lines (13)

represent water/brine swellable elastomers and the black disks (14) represent hydrocarbon swellable elastomers. Adhesives may be used on the core (12) and disks (13) to hold them in place;

FIG. 7 is a side view of two swellable elastomer sealing plug units (15) and (16) of one embodiment of the invention with a tubular core (19) incorporating either water/brine swellable elastomers (20) or hydrocarbon swellable elastomers (21) across the entire unit. The swellable elastomer is confined by baffle plates (22) and (23) which are attached to the central tubular core adjacent and in contact with the swellable elastomer at both ends. These baffle plates (22) and (23) confine longitudinal expansion and enhance circumferential expansion. The Sealing Plug Units are fabricated with box (17) and pin (18) connections so that the units can be attached to each other for running in hole and to achieve the desired total plug contact length. The box is the female connection and the pin is the male connection;

FIG. 8 is a side view of two swellable elastomer sealing plug units (24) and (25) of one embodiment of the invention with a tubular core (28) with alternating water/brine swellable elastomers (29—lighter lines with a down left slant) and hydrocarbon swelling elastomers (30—heavier lines with a down right slant). The swellable sealing plug units are fabricated with box (26) and pin (27) connections so that the units can be attached to each other for running into the wellbore and to achieve the desired total plug contact length when incorporated into plug systems. The box is the female connection and the pin is the male connection. Capping baffle plates are not incorporated into this embodiment.

Figure 9:
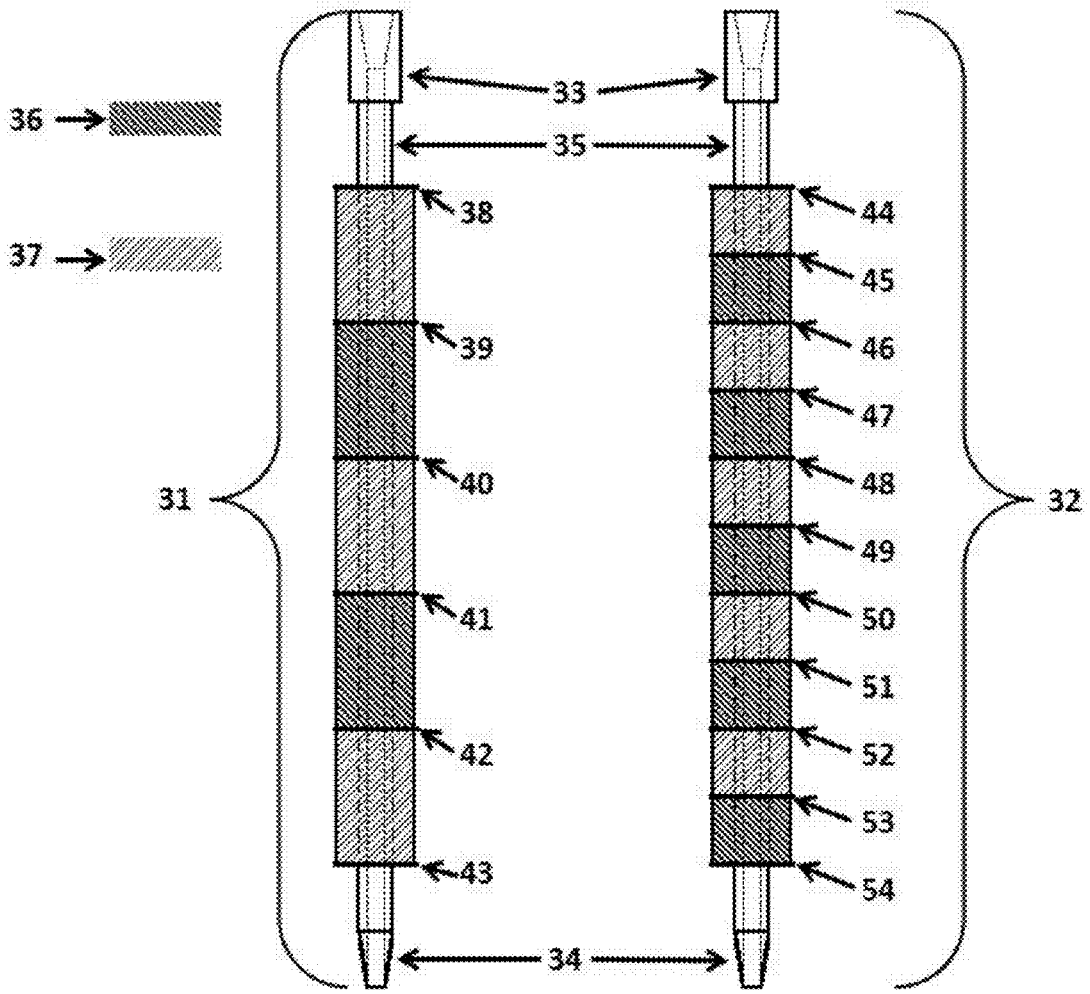
FIG. 9 is a side view of two Elastomer Sealing Plug Units (31 & 32) of an embodiment of the invention with a tubular core (35) with alternating water/brine swellable elastomers (37—light lines with downward left slant) and hydrocarbon swelling elastomers (36—dark lines with downward right slant) wherein the elastomers are confined by baffle plates.

FIG. 9 is a side view of two swellable elastomer sealing plug units (31 & 32) of an embodiment of the invention with tubular cores (35) with alternating water/brine swellable elastomers (37—lighter lines with a down slant left) and hydrocarbon swelling elastomers (36—heavier lines with a down slant right). The swellable elastomers of sealing plug 31 are confined by baffle plates (38, 39, 40, 41, 42 & 43) and the swellable elastomers of sealing plug 32 are confined by baffle plates (44, 45, 46, 47, 48, 49, 50, 51, 52, 53 & 54) which are attached to the central tubular adjacent and in contact with the swellable elastomer at both ends and in between the alternating elastomer types. These baffle plates confine longitudinal expansion and enhance circumferential expansion. The swellable elastomer sealing plug units are fabricated with female (33) and male (34) connections so that the units can be attached to each other for running into the wellbore and to achieve the desired total plug contact length when incorporated into plug systems.

Figure 10:
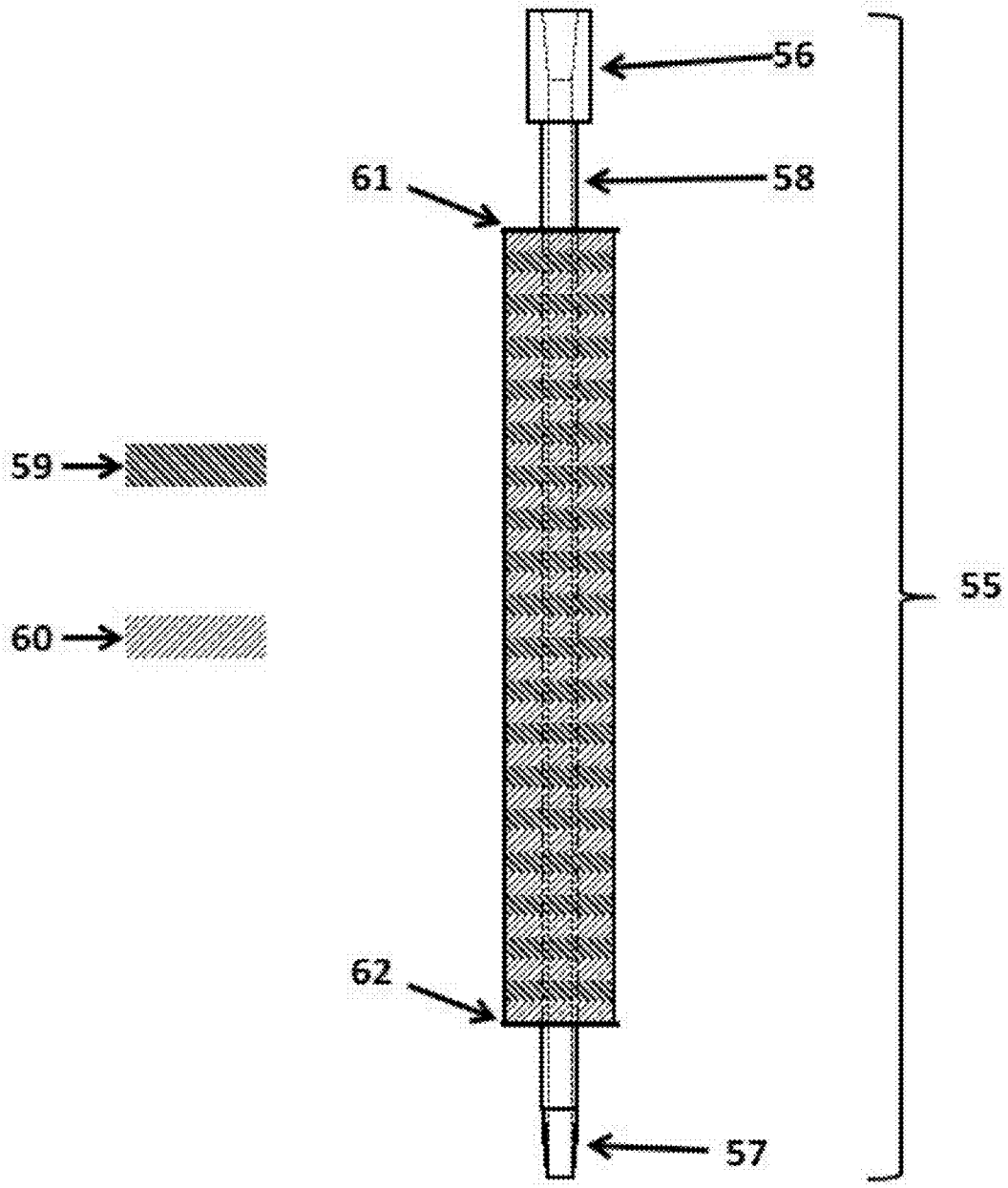
FIG. 10 is a side view of an Elastomer Sealing Plug Unit (55) of one embodiment of the invention with tubular core (58) with alternating water/brine swellable elastomers (60—light lines with downward left slant) and hydrocarbon swelling elastomers (59—dark lines with downward right slant) in stacked disks threaded onto the tubular core.
Figure 11:
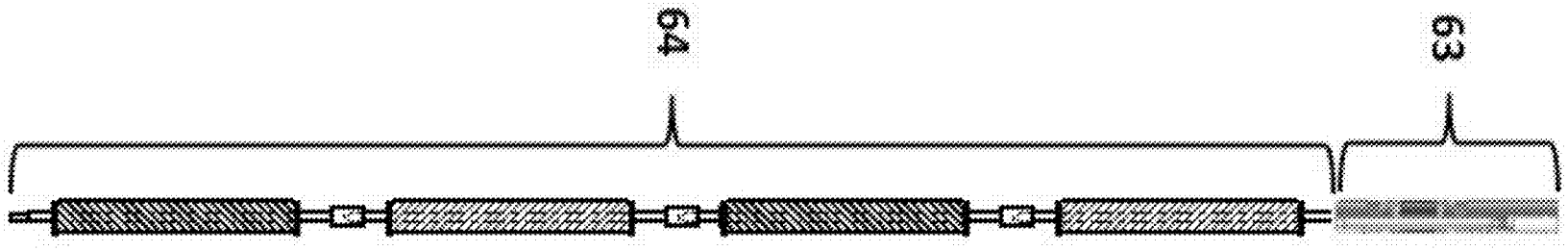
FIG. 11 is an example of four swellable elastomer units (64) with rod cores placed below a packer, cement retainer or cast iron bridge plug (63) for running into the wellbore, allowing the unit to be hung off at any location along the wellbore.

FIG. 10 is a side view of a swellable elastomer sealing plug unit (55) of one embodiment of the invention with tubular core (58) with alternating water/brine swellable elastomers (60—lighter lines with a down left slant) and hydrocarbon swelling elastomers (59—heavier lines with a down right slant) in stacked disks threaded onto the tubular core (58). Constraining baffle plates (61) and (62) are attached to the tubular core (58) to cap the ends of the elastomer units to assist in keeping the elastomer disks in place and also to confine longitudinal expansion and enhance circumferential expansion. The sealing plug unit is fabricated with box (56) and pin (57) connections so that the units can be attached to each other for running into the wellbore and to achieve the desired total plug contact length when incorporated into plug systems. The box is the female connection (56) and the pin is the male connection (57);

FIG. 11 is an example of four swellable elastomer sealing plug units (64) run in hole with a packer, cement retainer, or cast iron bridge plug (63) to allow the units to be "hung off" at any location within the wellbore.

Figure 12:
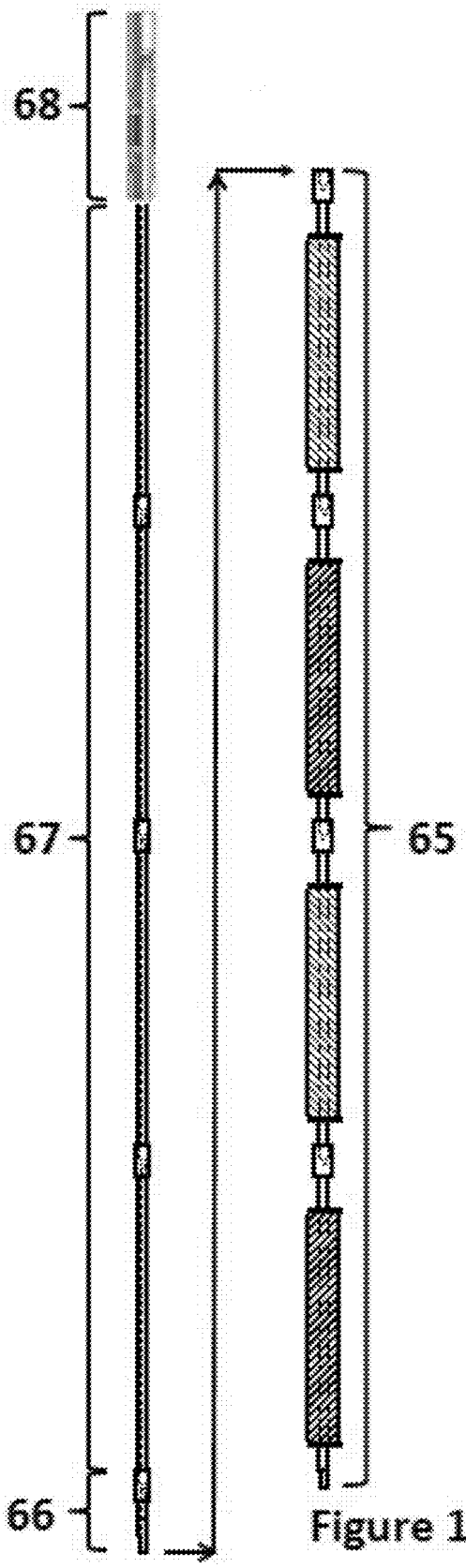
FIG. 12 is an example of four swellable elastomer units (65) below a side-ported circulating sub (66) and tubing (67) placed below a packer, cement retainer, or cast iron bridge plug (68) for running into the wellbore, allowing the unit to be hung off at any location within the wellbore after a setting medium has been circulated in place.

FIG. 12 is an example an elastomer plugging system consisting of four swellable elastomer sealing plug units (65) below a circulating sub (66) and tubing (67) all placed below a packer, cement retainer, or cast iron bridge plug (68) for running into the wellbore, allowing the unit to be hung off at any location within the wellbore. A circulating sub is a joint of drill pipe or work string tubular with a side port (hole) to allow circulation of fluid from the inside of the string to outside or vice versa. A settable medium can be pumped in place and then the hang off device (68) set.

Figure 13:
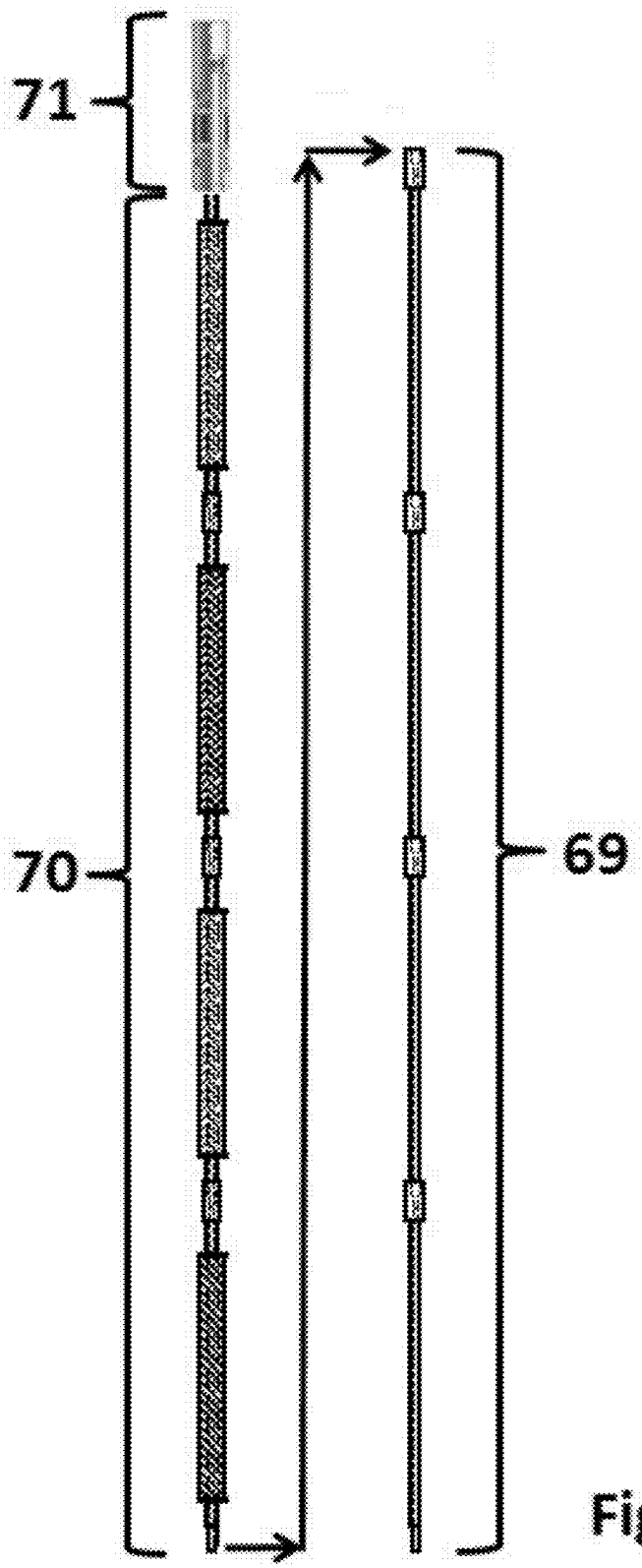
FIG. 13 is an example of tubing (69) run below four swellable elastomer units (70) that are run below a packer, cement retainer, or cast iron bridge plug (71). After a settable medium has been pumped to above the height of the hang off device (71) it can be set sealing off the wellbore and locking all components and the settable medium in place.

FIG. 13 is one example of a swellable elastomer sealing plug unit and settable medium plugging system. For this embodiment tubulars (69) are run in the hole open ended below swellable elastomer units (70) placed below a packer or cement retainer (71). A spacer is then pumped followed by a settable medium and when the designed column of settable medium has been balanced the packer or retainer is set. The running string is then pulled above the top of the settable medium, the hole circulated clean, and the medium is allowed time to set. After setting, the running string is slacked off until the top of the firm settable medium is determined. The running string is then pulled.

Figure 14:
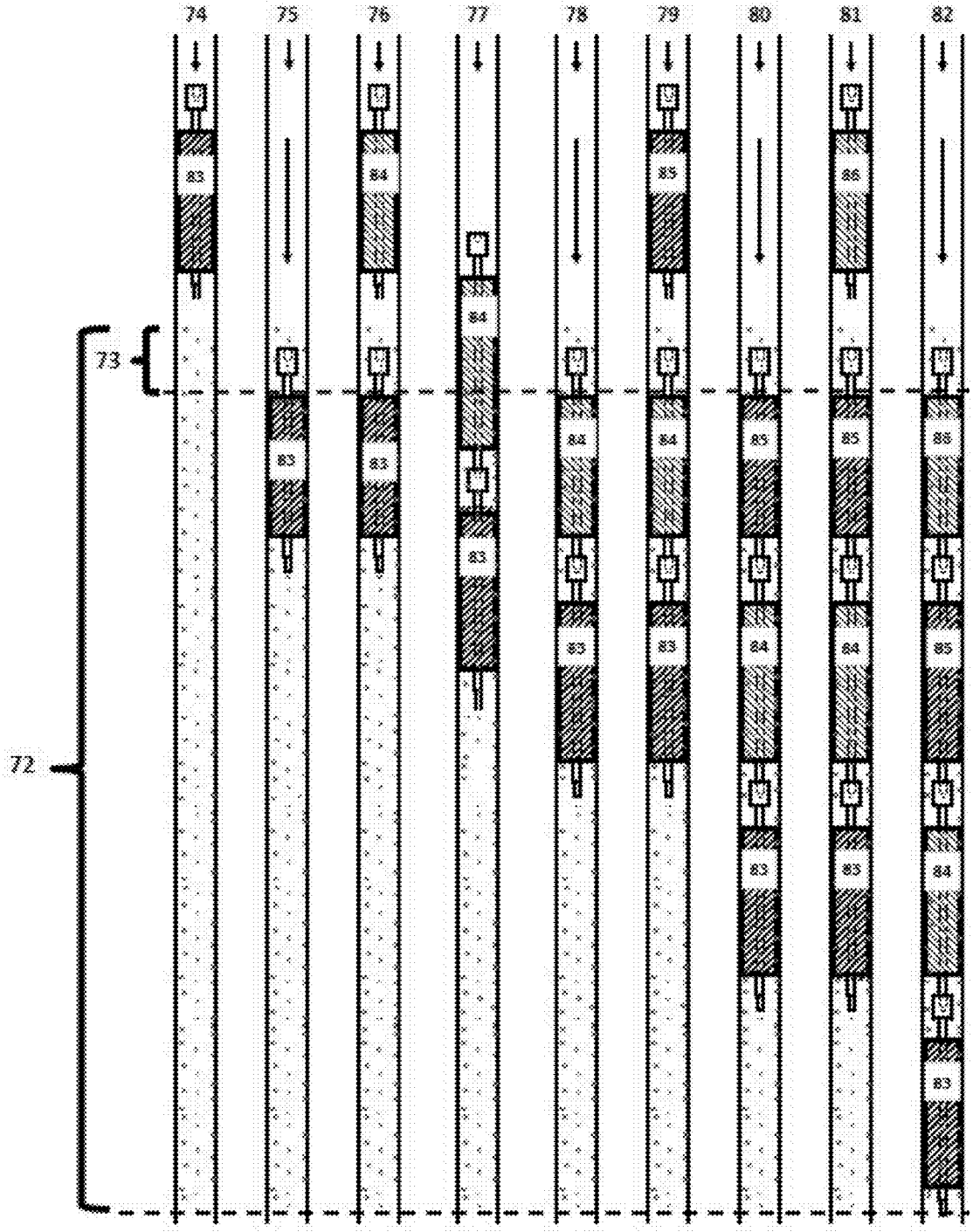
FIG. 14 is an example of a wellbore with a perforated completion interval (72). The most proximal portion of the perforations (top perforations) is labeled as 73. The same wellbore is represented by progressive steps labeled as 74, 75, 76, 77, 78, 79, 80, 81 and 82. Elastomer sealing units 83, 84, 85 and 86 are launched separately in progression and pumped downhole in order to seal off the perforations.

FIG. 14 is an example of a perforated wellbore section (72) with the most proximal perforations (top perforations) labeled as 73. The same wellbore is represented by progressive steps labeled at the top of the drawing as 74, 75, 76, 77, 78, 79, 80, 81 and 82. In wellbore representation 74, the elastomer sealing unit (83) has been launched downhole from surface and has progressed until it is located just above the top of perforations. In wellbore representation 75, as pumping continues, the top of the sealing unit (83) clears the top of the perforations, the pressure moving the unit forward leaks off at the perforations and forward movement of the elastomer sealing unit ceases. In wellbore representation 76 the second elastomer sealing unit (84) has been launched and pumped down the wellbore until just above the elastomer sealing unit (83). Pumping is continued and in wellbore representation 77, the two elastomer sealing units (84 & 85) have connected and are jointly being pushed forward within the wellbore until, in wellbore representation 78, the top of elastomer sealing unit 84 clears the top of the perforations and the pressure moving the units forward leaks off at the perforations and forward moment of the elastomer sealing units ceases. In wellbore representation 79 the third elastomer sealing unit (85) has been launched and pumped down the wellbore until just above the elastomer sealing unit (84). Pumping continues and in wellbore representation 80 the three elastomer sealing units (83, 84 & 85) have connected and are jointly being pushed forward within the wellbore until the top of unit 85 clears the top of the perforations, the pressure moving the units forward leaks off and forward moment of the elastomer sealing units ceases. In wellbore representation 81 the forth elastomer sealing unit (86) has been launched and pumped down the wellbore until just above the elastomer sealing unit 85. In wellbore representation 82 the four elastomer sealing units (83, 84, 85 & 86) are connected and are jointly being pushed forward within the wellbore until the top of unit 86 clears the top of the perforations, the pressure moving the units forward leaks off and forward moment of the elastomer sealing units ceases. The sealing plugs can now be left to expand and seal the wellbore across perforations where they are located. Now cement spacer can be pumped downhole followed by a lead wiper plug cement and a tail wiper plug. The forward progress of the wiper plugs and cement will cease when the lead wiper plug lands out on the last elastomer sealing plug unit (86) sealing off the perforations. The wellbore is now sealed with elastomer sealing plugs across the perforations and a cement plug across from the well cemented casing annulus above the completion.

Figure 15:
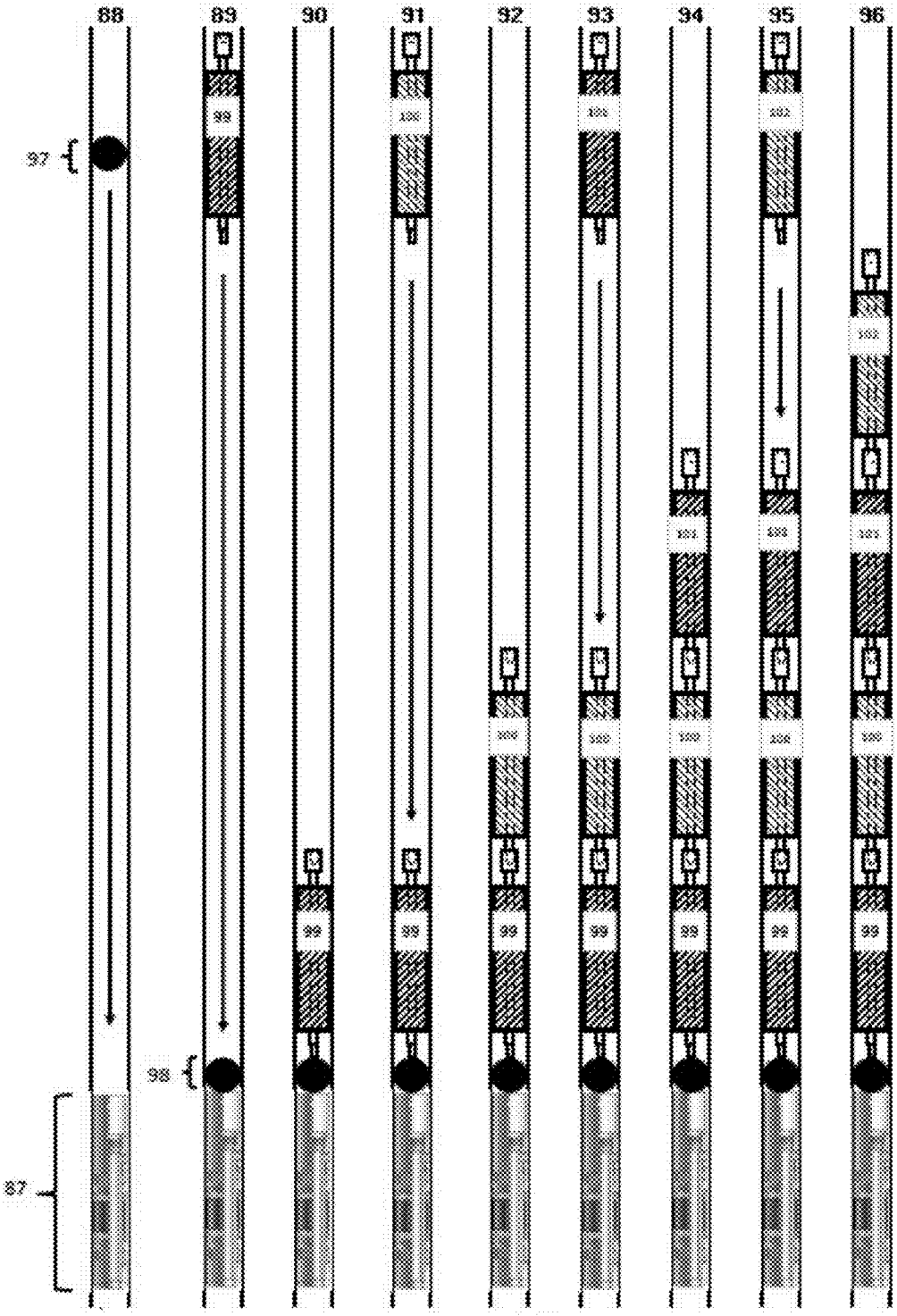
FIG. 15 is an example of a wellbore with a packer (87) placed downhole as a base for landing out swellable elastomer sealing plug units (99), (100), (101) and (102) which have been launched individually and pumped downhole to land out on a backpressure ball device (98)

FIG. 15 provides progressive time shots of the same wellbore are denoted by 88, 89, 90, 91, 92, 93, 94, 95 and 96. In this example a packer (87) is located downhole which is used as a base for landing a backpressure ball device (97) followed by swellable elastomer plug units (99), (100), (101) and (102) which are pumped downhole in succession. The plug external diameters have tolerances which allow fluid to bypass or flow around them until they have had time to swell and seal off the wellbore.

Figure 16:
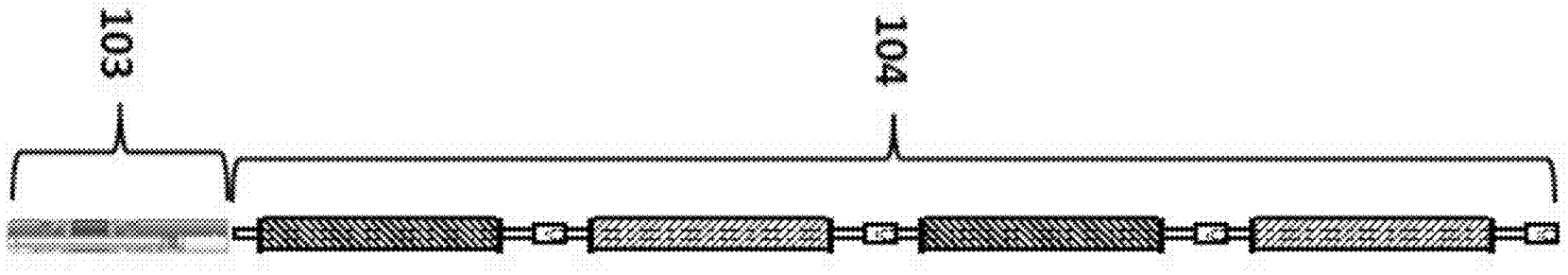
FIG. 16 is an example of swellable wellbore sealing plug units (104) run in hole along with a settable packer, cement retainer, or bridge plug (103)

FIG. 16 is an example of swellable elastomer sealing plug units (104) with rod cores run in hole together above a packer, cement retainer, or bridge plug (103). When the sealing plug units are at the desired location within the wellbore, the packer, cement retainer, or bridge plug is set and elastomer sealing plugs are left to swell and seal the wellbore. A setting medium may then be pumped downhole to set-up on top of the entire elastomer sealing plug system.

Figure 17:
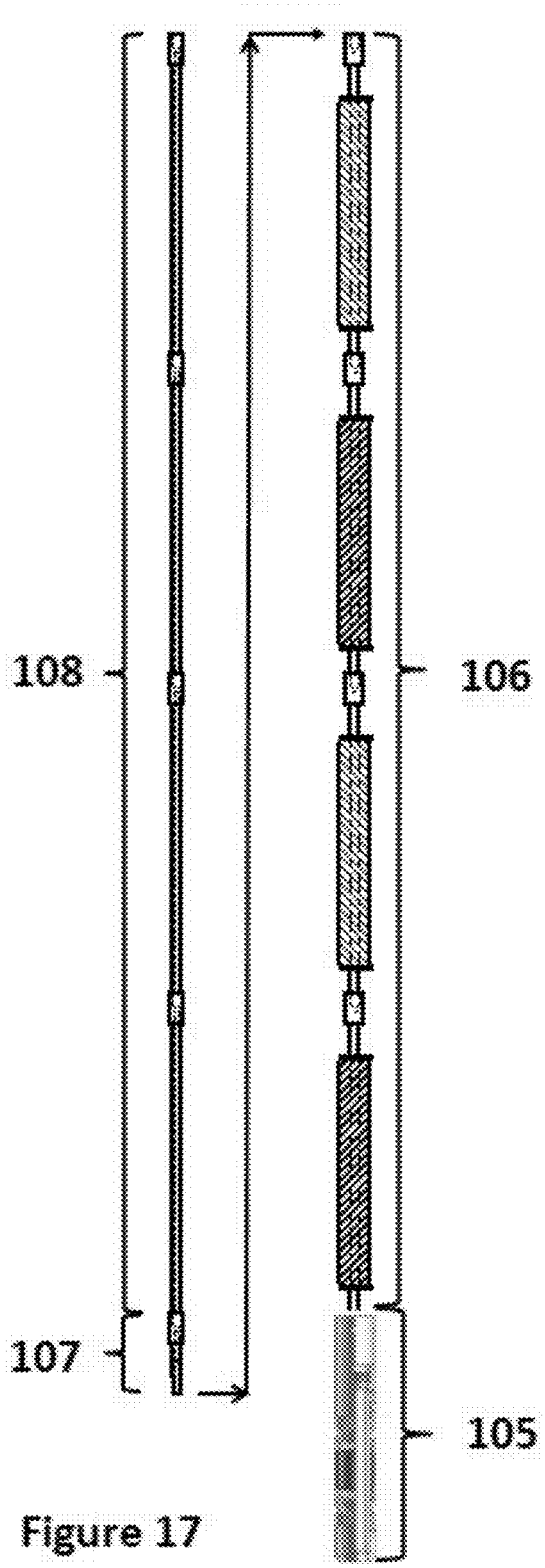
FIG. 17 is an example of a packer, cement retainer, or bridge plug (105) run in hole with swellable elastomer sealing plug units with rod cores (106) followed by a circulating sub (107) and tubing.

FIG. 17 is an example of swellable elastomer sealing plug units (106) with rod cores run in hole together above a packer, cement retainer, or bridge plug (105) along with a circulating sub (107) and tubing (108). When the sealing plug units are at the desired location within the packer, the cement retainer, or bridge plug is set and the elastomer sealing plugs are left to swell and seal the wellbore. A settable medium can now be pumped downhole and out through the circulating sub, with a side port, until the medium is balanced. The running string can then be released leaving the tubing (108) in place. The hole is then circulated clean and the running string pulled from the wellbore.

In wells with a mono-bore completion, completion intervals can be sealed off by pumping swellable elastomer sealing units downhole using a lubricator to launch them at the wellbore surface. The swelling elastomer sealing units are conveyed downhole much like a pipeline pig being pumped along a pipeline. Each progressive unit meets up and latches to the previous units at the top of the completion interval moving all units forward together.

Swellable elastomer plugs allow for selectively plugging off production intervals below the top of the swelling elastomer sealing system.

A swellable elastomer plugging unit system can be used to seal off open-hole intervals.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventor that variations and equivalents of the invention are within the scope of the claims while the description, abstract and drawings are not to be used to limit the scope of the invention. The invention is specifically intended to be as broad as the claims below and their equivalents. No limitations are intended to the details of construction or design herein shown, other than as described in the claims below. While products and methods are described in terms of "comprising," "containing," "having," or "including" various components or steps, the products and methods can also "consist essentially of" or "consist of" the various components and steps. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined herein.

What is claimed is:

1. A process for permanently plugging a wellbore having a well casing and an annulus between the wellbore and the well casing, wherein the process comprises the steps of:

a) gaining access to the wellbore;
b) running a gauging device into the wellbore to assure passage of all plugging components;
c) running in the wellbore annulus swellable elastomer units comprising hydrocarbon swellable components cut into disks and adhered to a central rod or tubular;
d) conveying the swellable elastomer units to the planned location within the wellbore;
e) allowing the swellable elastomer units to swell, forming a cross-sectional barrier and mixing, pumping, and displacing a settable medium into the wellbore, plugging the wellbore for abandonment.

2. The process of claim 1 wherein the swellable elastomer units have end connections connecting the units together.

3. The process of claim 1 wherein baffle plates are connected to the rod or tubular cores and confine longitudinal expansion and enhance circumferential expansion of the swellable elastomer units during swelling.

4. The process of claim 1 further comprising protecting the swellable elastomer units with baffle plates while the units are being run in the wellbore.

5. The process of claim 1 wherein the swellable elastomer units further comprise water/brine swellable units or components.

6. The process of claim 5 wherein the swellable elastomer units are combined into a plugging system.

7. The process of claim 5 wherein the plugging system further incorporates a settable medium.

8. The process of claim 1 wherein the swellable elastomer units are conveyed into the wellbore by drill pipe, work string, coiled tubing, wireline, braided line, or are hydraulically pumped into position within the wellbore.

9. The process of claim 1 wherein the swellable elastomer units seal off the interior of casing, tubing, perforated completion intervals, completion screens or open-hole interval to plug the wellbore.

* * * * *